US005704776A

United States Patent [19]

Sher

[11] Patent Number: 5,704,776

[45] Date of Patent: Jan. 6, 1998

[54] SAFETY LOCK LIGHTER

[75] Inventor: Tak Chi Sher, North Point, Hong Kong

[73] Assignees: Polycity Industrial Ltd.; Tak Fi International (Holdings) Ltd., both of Quarry Bay, Hong Kong

[21] Appl. No.: 172,614

[22] Filed: Dec. 22, 1993

[51] Int. Cl.[6] ..... F23D 11/36

[52] U.S. Cl. ..... 431/153; 431/277

[58] Field of Search ..... 431/153, 277, 431/255

[56] References Cited

U.S. PATENT DOCUMENTS

| | | | |
|---|---|---|---|
| 5,074,781 | 12/1991 | Fujita | 431/277 X |
| 5,092,764 | 3/1992 | McDonough et al. | 431/277 |
| 5,165,885 | 11/1992 | Iwahori | 431/153 |
| 5,197,870 | 3/1993 | Yang | 431/153 |
| 5,213,495 | 5/1993 | Pan | 431/153 |
| 5,215,458 | 6/1993 | Cirami | 431/277 |
| 5,224,854 | 7/1993 | Ansquer | 431/277 X |
| 5,271,731 | 12/1993 | Hsin-Chung | 431/153 |
| 5,324,193 | 6/1994 | Pan | 431/277 X |

FOREIGN PATENT DOCUMENTS

| | | | |
|---|---|---|---|
| 0296281 | 12/1988 | European Pat. Off. | 431/153 |

*Primary Examiner*—Carl D. Price
*Attorney, Agent, or Firm*—Ladas & Parry

[57] ABSTRACT

A safety lighter is disclosed. The lighter comprises a lighter body, a nozzle, a mounting frame disposed on the lighter body, and an actuating lever which is reciprocatingly mounted on the mounting frame between forward and rearward positions. The front end of the lever grips the nozzle and moves it from its lower position, where gas cannot escape from said nozzle, to the nozzle's upper position where gas is ejected from said nozzle. The rear end of the lever has a downwardly extending projection which can be received into a recess in the top of the lighter body when the lever is in the forward position. When the lever is in the rearward position and the rear end of the lever is pressed downward, its projection comes into vertical engagement with the top of the lighter body, which prevents the lever from pivoting far enough to lift the nozzle. In a preferred embodiment a spring is disposed in the recess, which spring acts to urge the lever rearward and also acts to urge the rear end of the lever to pivot upward.

3 Claims, 4 Drawing Sheets

SAFETY LOCK LIGHTER

BACKGROUND OF THE INVENTION

This invention relates to the field of lighters, such as cigarette lighters.

Modern butane lighters have become very popular. One of the reasons for their popularity is that the height of the flame produced by the lighter can be varied over a wide range by varying the amount of fuel allowed to be ejected from the lighter. The very feature which makes such lighters attractive to the users also makes such lighters dangerous if they are accidentally ignited. When the lighter produces a flame in an uncontrolled circumstance, particularly when the lighter is set on its high setting, materials (such as clothing, curtains and hair) may accidentally be lit on fire.

Also, modern butane lighters suffer from the potential that the lever which actuates the lighter's nozzle will accidentally be depressed thereby causing an unintended ejection, and therefore, loss of fuel stored within the lighter body.

The invention disclosed herein significantly reduces the risk that the foregoing problems will be incurred by the provision of a safety lock feature which prevents the lighter's nozzle from being put into the actuated position unless the user deliberately puts the lighter in an operational condition. In a preferred embodiment of the invention, the safety lock mechanism of the invention is automatically engaged.

SUMMARY OF THE INVENTION

Conventional lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker, flint, and flint spring combination, which igniter is positioned close to the rear end of the lever so that the igniter and the rear end of the lever may be actuated nearly simultaneously. When this occurs a flame is caused to be ignited from the head of the nozzle through which fuel is being ejected while the rear end of the lever is being held down.

The invention is an improved lighter which is attained by adding a safety means to the lighter. The safety means is comprised of a projection or step which extends downwardly from the rear end of the lever; structure for reciprocatingly mounting the nozzle actuating lever to the mounting frame between first and second positions, and a recess formed in the top surface of the lighter body. The recess is positioned directly under the space occupied by the downwardly extending step of the rear end of the lever when the lever is in the second, or operational position. When the lever is in the first or safety position, at least a portion of the step is vertically aligned over a portion of the top surface of the lighter body. When the lever is in the safety position and the user attempts to push down on the rear end of the lever, the step comes into vertical engagement with the top surface of the lighter body before the lever has been able to travel a sufficient distance to actuate the lighter nozzle. The recess in the top of the lighter body is large enough to receive the downwardly extending step so that when the lever is in the second, or operational, position the lever may be pushed downward a sufficient distance that the lighter's nozzle is actuated.

In a preferred embodiment, a spring is inserted into the recess and engages a hollow formed in the bottom of the step. The spring acts so as to urge the rear end of the lever upward and to urge the entire lever toward the first or safety position. Thus, the lighter returns to the safety locked position automatically when the user stops exerting pressure on the rear end of the lever.

DETAILED DESCRIPTION OF THE INVENTION

Figure 1:
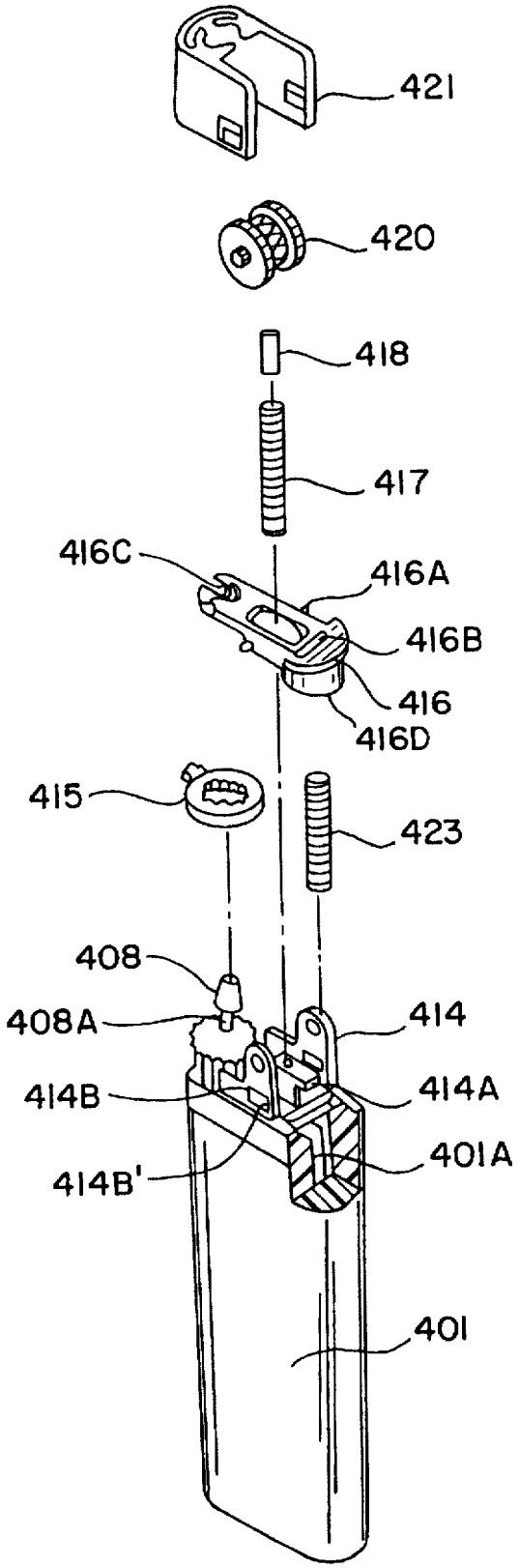
FIG. 1 is an exploded view of the safety lock lighter of the present invention.

The preferred embodiment of the subject invention is illustrated in the attached drawings which are referred to herein. The same reference numeral will be used to identify identical elements throughout the drawings.

FIG. 1 illustrates components commonly mounted on a lighter body 401 in which lighter fuel is contained. Such components include nozzle 408, including a head and downwardly extending tube 408A, mounting frame 414, flame adjustment wheel 415, the igniter comprising flint spring 417, flint 418 and striker 420, nozzle actuating lever 416, and windshield 421. Nozzle tube 408A is connected in communicating relationship with the interior of the lighter body where fuel is stored. When the nozzle is in its raised position, fuel can be ejected from it. When the nozzle is in its lower position, fuel cannot be ejected from it.

Also illustrated in FIG. 1 are elements forming a safety means of the present invention. These include recess 401A which is formed in the top surface of the lighter body; projection or step 416D which extends downwardly from the rear end of lever 416; compression spring 423; retention hook 414A formed on the mounting frame 414; and depression 416B formed in the upper surface of the nozzle actuating lever.

Figure 2:
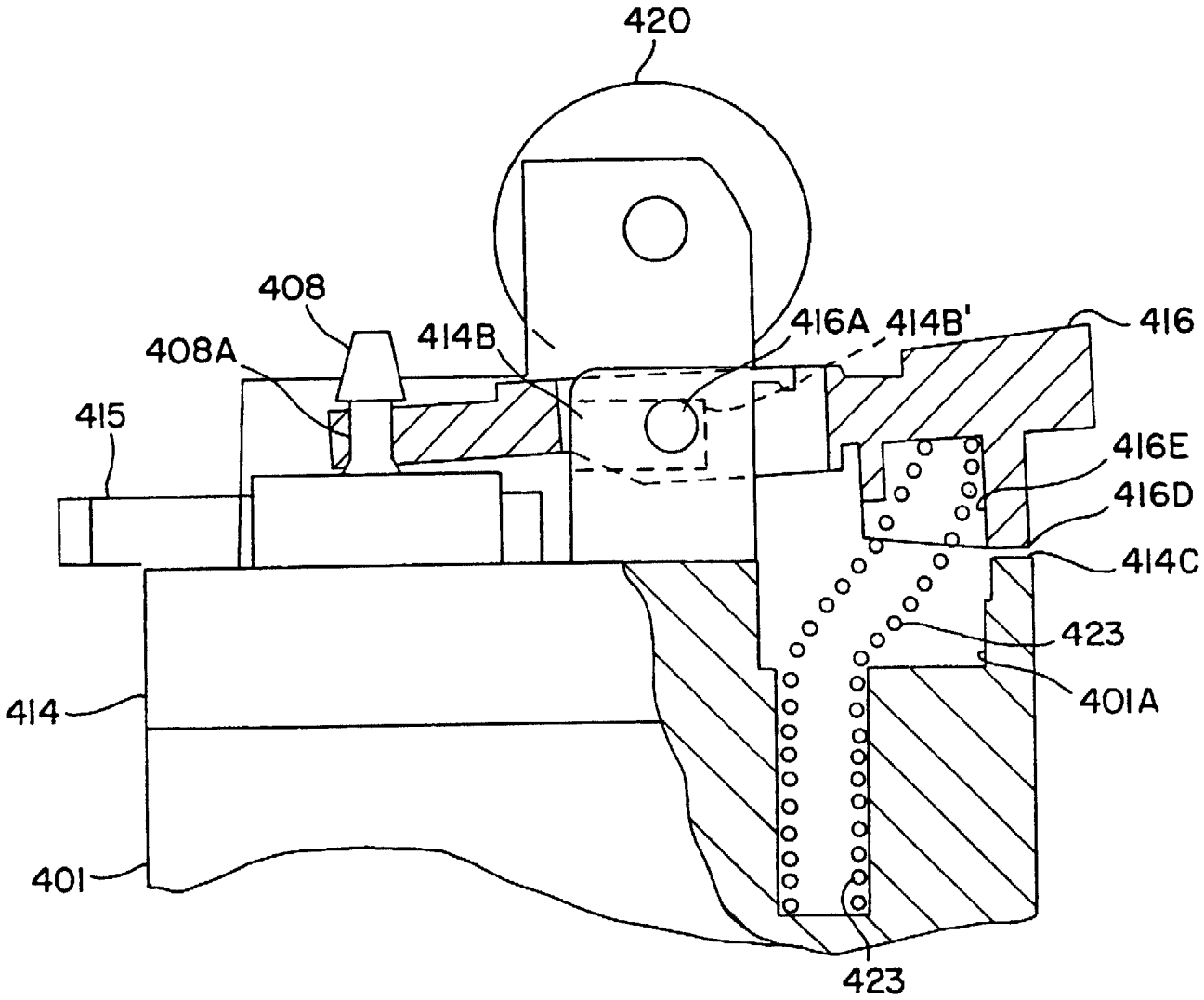
FIG. 2 is a partial side elevational view of the lighter of the present invention, partially broken away, illustrating the lighter in its safety locked condition, with the lighter's wind shield removed.

FIG. 2 illustrates the nozzle actuating lever 416 in the safety locked position, preventing the ejection of gas as a result of the effect of the safety means. The nozzle actuating lever 416 is pushed rearward, and its rear end is pushed upward, by the restoring force of the compression spring 423, the bottom end of which is disposed in recess 401A. The top end of spring 423 is disposed in hollow 416E formed in the bottom of projection or step 416E, which extends downward from the lever's rear end. This places a portion of step 416D of the lever just above supporting edge 414C of the mounting frame 414, which is overlying a portion of the top surface of the lighter body. Thus, the rear end of the nozzle actuating lever 416 is prevented from being pressed downward and causing the front end of the lever from rising up. At this moment, the pivoting axle or fulcrum 416A of the nozzle actuating lever 416 is situated at the position 414B' in the fulcrum guide slot 414B (shown in phantom lines) of the mounting frame 414. Because slot 414B is elongated, the lever may reciprocate forward and rearward as its fulcrum slides from one extreme of fulcrum guide slot 414B to the other.

Figure 3:
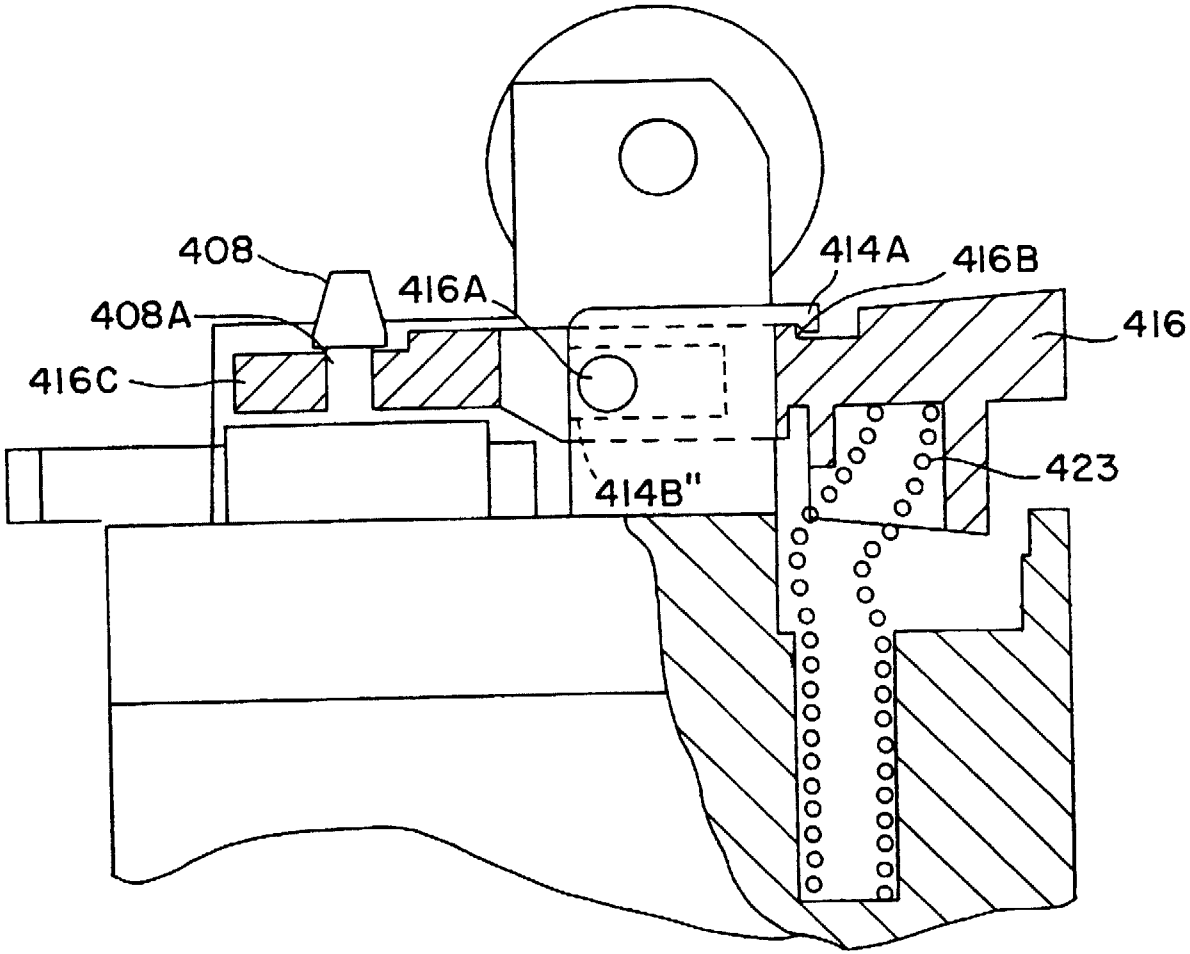
FIG. 3 is a partial side elevational view of the lighter of the present invention, partially broken away, illustrating the lighter in its operational condition, with the lighter's wind shield removed.

Referring to FIG. 3, the nozzle actuating lever 416 is pushed forward against the resistance of the compression spring 423 to attain a position allowing the ejection of gas. Retaining hook 414A, of the mounting frame, engages depression 416B, thereby preventing the lever 416 from retreating to its rearward or first position. At this moment, the pivoting axle 416A of the nozzle actuating lever has moved forward to the position 414B" in the fulcrum guide slot of the mounting frame. Step 416D is now vertically above recess 401A. The recess is dimensioned so as to receive the entirety of step 416D when the rear end of lever 416 is pressed downward.

The front end of the nozzle actuating lever is provided with a gripper slot 416C. As a result, the front end of the lever grips the nozzle 408 around its neck and under its head. Thus, in the operational condition illustrated in FIG. 3, lever 416 is in a position of being able to raise nozzle 408 to eject gas when the rear end of the lever is pressed downward. The compression spring 423 is compressed, attaining additional restoring energy in the spring.

Figure 4:
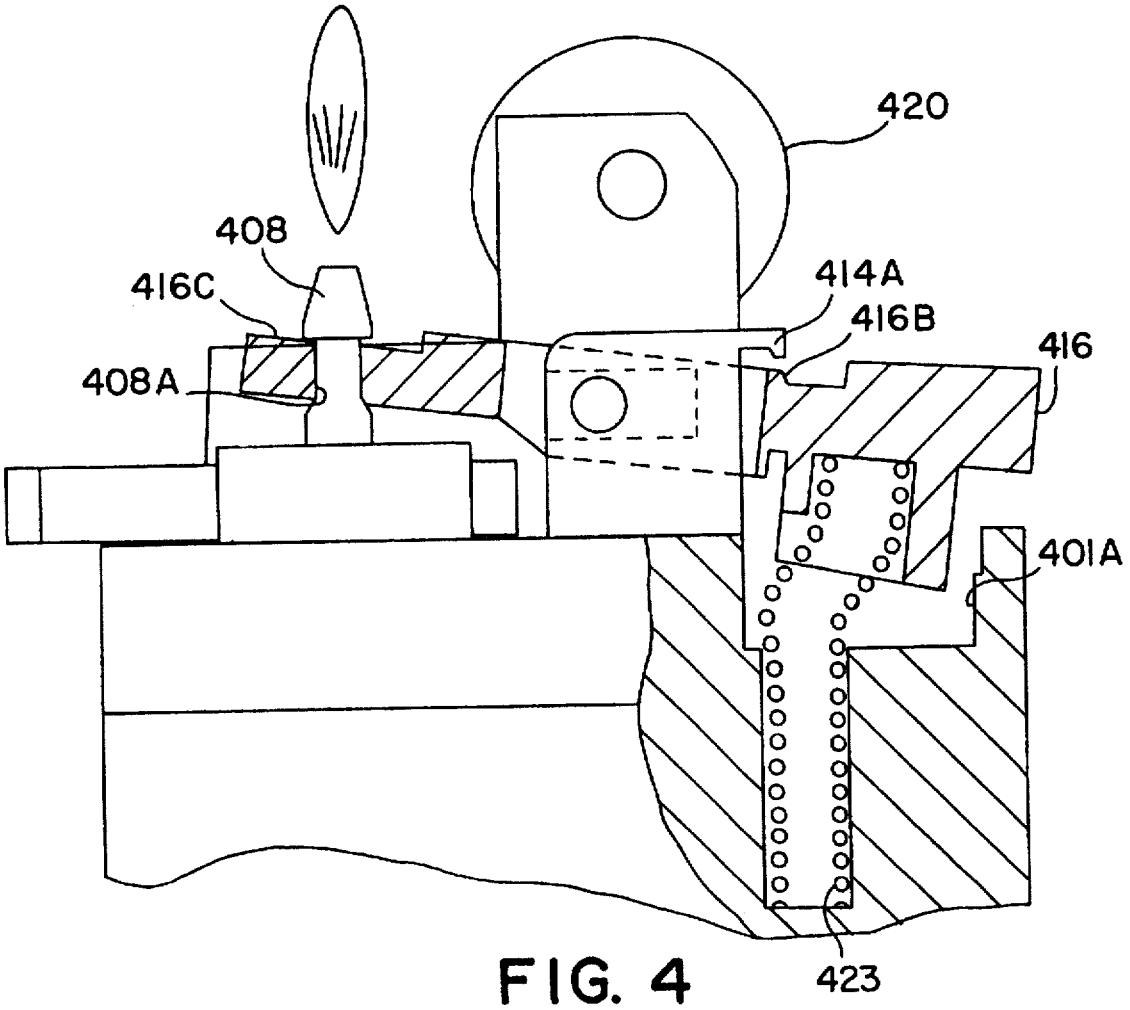
FIG. 4 is a partial side elevational view of the lighter of the present invention, partially broken away, illustrating the lighter in its operational condition and with its nozzle actuating lever in its actuating position, with the lighter's wind shield removed.

Referring to FIG. 4, pivoting axle 416A of the lever takes the structure forming the fulcrum guide slot of the mounting frame 414 as a fulcrum bearing to raise nozzle 408 when the gas lever is pressed downward. The depression 416B in the upper surface of the lever 416 will be released from the retaining hook 414A, and the compression spring is further compressed.

Striker wheel 420 is actuated to strike the flint 418 to generate a spark. The rear end of the lever 416 is pressed downward virtually simultaneously with the striker wheel being actuated while the nozzle 408 is raised upward by the front end gripper portion of the nozzle actuating lever, ejecting gas to light a flame. The striker wheel 420 stops immediately after the instantaneous rotation of lighting a flame, while the ejection of gas and the flame are maintained during the period that the rear end of lever is being pressed downward.

The user's finger pressing on the rear lever 416 will be removed after the lighting (e.g., of a cigarette), and the lever, with its depression 416B disengaged from the retaining hook 414A, will return to the safety locked position shown in FIG. 2 under the effect of the restoring force of compression spring 423. This causes the nozzle to be lowered, the ejection of gas to be cut off, and the flame from the lighter to be extinguished. Thus, the lighter returns automatically to the safety locked position, preventing the accidental ejection of gas as shown in FIG. 2.

Above there has been described a unique safety lock lighter. It will be understood that various changes of the details, materials, arrangements of parts and uses which have been herein described and illustrated in order to explain the nature of the invention will occur to and may be made by those skilled in the art upon the reading of this disclosure, and such changes are intended to be included within the principles and scope of this invention.

I claim:

1. A lighter comprising, a lighter body containing fuel in its interior;

a mounting frame disposed atop said lighter body;

a nozzle having two ends, one of which is disposed in communicating relationship with the lighter body's interior and the other end comprising a head extending above the lighter body, said nozzle reciprocatingly mounted upon said lighter body between a lower position and an upper position, said nozzle being configured so that fuel stored in said interior of said lighter body may be ejected from said nozzle head when said nozzle is in the upper position, and when said nozzle is in said lower position fuel cannot be ejected from said nozzle head;

a nozzle actuating lever having a front end and a rear end and a fulcrum disposed intermediate said front and rear ends, said lever having at its front end a gripper engaging said nozzle, said lever being reciprocatingly mounted upon said mounting frame between a first position and a second position;

said rear end of said lever having a step extending downward therefrom and said lighter body having a top surface having a recess therein disposed beneath said step when said lever is in said second position, at least a portion of said step being vertically aligned with a portion of said top surface of said lighter body when said lever is in said first position, said step having a length such that when said rear end of said lever is pushed downward during the time that said lever is in said first position, said step comes into vertical engagement with said top surface of said lighter body before said nozzle is raised to its upper position by the front end of said lever, and said recess being configured so as to receive said step when said lever is in said second position such that when said rear end of said lever is pushed downward by a user of said lighter during the time that said lever is in said second position, said nozzle is raised to its upper position by said front end of the lever, said step having a hollow formed in its bottom; and a spring having a bottom end and a top end, the bottom end of which is disposed in said recess and the top end of which is disposed in said hollow, said spring acting to urge said rear end of said lever upward and rearward when said step has been received in said recess so as to automatically move said lever into said first position when the user of said lighter is no longer pushing said rear end of said lever downward.

2. The lighter of claim 1 wherein a slot is formed in said mounting means above said lighter body, in which slot said fulcrum of said lever is slidably received.

3. The lighter of claim 1, said mounting frame comprising a retaining hook and said lever having a depression formed therein, wherein said hook is releasably engaged in said depression when said lever is in said second position so as to retain said lever in said second position until said rear end of said lever is pushed downward.

* * * * *